US006821214B2

(12) United States Patent
Rice

(10) Patent No.: US 6,821,214 B2
(45) Date of Patent: Nov. 23, 2004

(54) METAL WOOD GOLF CLUB HEAD

(75) Inventor: Scott A. Rice, Solana Beach, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 10/038,235

(22) Filed: Oct. 19, 2001

(65) Prior Publication Data

US 2003/0078113 A1 Apr. 24, 2003

(51) Int. Cl.[7] ..... A63B 53/04
(52) U.S. Cl. ..... 473/345; 473/342
(58) Field of Search ..... 473/324, 345, 473/329, 330, 334, 335, 341, 349, 290, 348

(56) References Cited

U.S. PATENT DOCUMENTS

| | | | | | |
|---|---|---|---|---|---|
| 4,471,961 | A | * | 9/1984 | Masghati et al. | 473/330 |
| 5,024,437 | A | | 6/1991 | Anderson | 273/78 |
| 5,094,383 | A | | 3/1992 | Anderson et al. | 228/176 |
| 5,219,408 | A | * | 6/1993 | Sun | 164/76.1 |
| 5,261,663 | A | | 11/1993 | Anderson | 273/78 |
| 5,310,185 | A | * | 5/1994 | Viollaz et al. | 473/330 |
| 5,310,186 | A | | 5/1994 | Karsten | 273/171 |
| 5,344,140 | A | | 9/1994 | Anderson | 273/78 |
| 5,346,217 | A | | 9/1994 | Tsuchiya et al. | 273/167 R |
| D366,080 | S | | 1/1996 | Chou et al. | D21/214 |
| 5,755,624 | A | | 5/1998 | Helmstetter | 473/291 |
| 5,851,160 | A | | 12/1998 | Rugge et al. | 473/349 |
| 5,954,596 | A | * | 9/1999 | Noble et al. | 473/346 |
| 6,238,300 | B1 | | 5/2001 | Igarashi | 473/324 |
| 6,306,048 | B1 | * | 10/2001 | McCabe et al. | 473/333 |
| 6,319,150 | B1 | * | 11/2001 | Werner et al. | 473/349 |
| 6,334,817 | B1 | * | 1/2002 | Ezawa et al. | 473/324 |
| 6,338,683 | B1 | * | 1/2002 | Kosmatka | 473/329 |
| 6,354,962 | B1 | * | 3/2002 | Galloway et al. | 473/342 |
| 6,398,666 | B1 | * | 6/2002 | Evans et al. | 473/345 |
| 6,458,043 | B1 | * | 10/2002 | McCabe et al. | 473/330 |

* cited by examiner

*Primary Examiner*—Glenn Caldarola
*Assistant Examiner*—Tom P Duong
(74) *Attorney, Agent, or Firm*—D. Michael Burns

(57) ABSTRACT

A metal wood golf club head having a stamped metal impact insert welded to the body of the club head at a suitable distance from the crown/face perimeter or the sole plate/face perimeter transition junctions. Thereby maximizing the Coefficient of Restitution value for the club by relocating the welds away from the transition junctions that are subject to the greatest stresses.

The present invention having a metal weight disposed at a point rearward from the point where the hosel centerline would intersect with the sole plate. The metal weight disposed on the sole plate adjacently or in close proximity to the heel and skirt juncture.

18 Claims, 2 Drawing Sheets

METAL WOOD GOLF CLUB HEAD

FIELD OF THE INVENTION

The present invention relates generally to a metallic hollow golf club head, and specifically, to the placement of a stamped insert into the face of the club. This invention is also directed to a weight element being located on the sole in the heel/skirt regions of the club.

BACKGROUND OF THE INVENTION

Golf club "metal woods", were originally manufactured primarily by casting of durable metals such as stainless steel, aluminum, beryllium copper, etc. into a unitary structure comprising of a metal body, face and hosel. As technology progressed it became more desirable to strengthen the face of the club, and usually this was achieved by using a titanium material.

With a high percentage of amateur golfers constantly searching for more distance on their drives, the golf industry has responded by providing golf clubs specifically designed with distance in mind. The head sizes have increased which allows for the club to possess a higher moment of inertia, which translates to a greater ability to resist twisting on off-center hits. As a wood head becomes larger, its center of gravity will be moved back away from the face resulting in hits flying higher than expected. Reducing the lofts of the larger head clubs can compensate for this. Also the larger heads, because the center of gravity is moved further away from hosel axis, can cause these clubs to remain open on contact, thereby inducing a "slice" effect (in the case of a right-handed golfer the ball deviates to the right). Offsetting the head and incorporating a hook face angle can help compensate for this by "squaring" the face at impact, but often more is required to eliminate the "slice" tendency. The present invention provides such a solution.

Another technological breakthrough in recent years towards providing the average golfer with more distance is to make larger head clubs, while keeping the weight constant or even lighter, by casting consistently thinner shell thickness and going to lighter materials such as titanium. Also the face of the clubs have been steadily becoming extremely thin. The thinner face will maximize what is known as the COR (Coefficient of Restitution). The more a face rebounds upon impact, the more energy that may be imparted to the ball, thereby increasing distance.

In order to make the faces thinner, manufacturers have moved to a forged or stamped metal face which are stronger than cast faces. Common practice is to attach the forged or stamped metal face by welding them to the body at the sole and crown junctions. The present invention provides a novel method for attaching an impact face to the club without sacrificing any COR (Coefficient of Restitution) value in the club.

The prior art teaches methods to enhance the weight distribution of metal woods to help reduce the club from being open on contact with the ball. Usually, this is accomplished by the addition of weights to the body casting itself or strategically adding a weight element at some point in the club. Many efforts have been made to incorporate weight elements into the metal wood head. They are usually placed at specific locations, which will have a positive influence on the flight of the ball or to overcome a particular golfer's shortcomings. As previously stated, a major problem area of the higher handicap golfer is the tendency to "slice" which besides deviating the ball to the right, also imparts a greater spin to the ball. To reduce this tendency, the present patent teaches the placing of a weight element directly into the club head. The placement of the weight is designed so that the spin of the ball will be reduced, and also a "draw" (a right to left ball flight for a right-handed golfer) will be facilitated into the ball flight. This ball flight pattern is also designed to help the distance challenged golfer because a lower spinning ball will generally roll a greater distance after hitting the ground than it would roll with a higher spin. The present invention provides such a golf club.

Several patents have been issued which are directed towards using an insert in the face of the club to increase the strength therein. One such patent, U.S. Pat. No. 5,344,140 issued to Anderson, cites a face plate of forged metal.

None of the above inventions and patents, either singly or in combination, is seen to describe the instant invention as claimed.

SUMMARY OF THE INVENTION

In accordance with one aspect of the invention, a metal wood golf club head is provided which includes a hollow body having a stamped metal impact face welded to it. The body is preferably cast as a single member and includes an inner cavity surrounded by a sole plate, a crown portion, a toe portion, a heel portion, a skirt portion and a face perimeter forming an oval opening. The present invention utilizes a sheet metal insert that is preferably placed into the face approximately 0.20" removed from the crown portion and 0.20" removed from the sole plate. The face insert should be at least 0.15" from either the crown portion or the sole plate. The shell of the face perimeter is preferably of uniform thickness and less than the thickness of the insert. The insert preferably has a thickness that varies based on a double radii method that is described later.

In accordance with another aspect of the invention, the club head includes the addition of a weight element to the sole plate. The purpose of this weight addition is to reduce the tendency of a golfer to slice and to lower the spin rate of the ball, which actually tends to increase distance. The weight element is centered substantially on a projection extending away from and generally perpendicular to the impact face on a line through a point where the shaft centerline would meet the sole plate. The center of gravity of the weight element is thus substantially directly behind the point where the hosel axis intersects the sole plate. Preferably, the weight element is placed at a juncture of the heel/skirt portions of the sole plate. The weight element may be either cast with the body or can be a separate piece attached to the sole plate by conventional means such as welding. The center of the weight element should be at least 1.0" and preferably more than 1.5" from the intersection point of the hosel centerline and the sole plate. It is anticipated that the weight element be greater than 12 grams and more preferably greater than 16 grams.

DETAILED DESCRIPTION OF THE PREFERRED EMBODIMENTS

Figure 1:
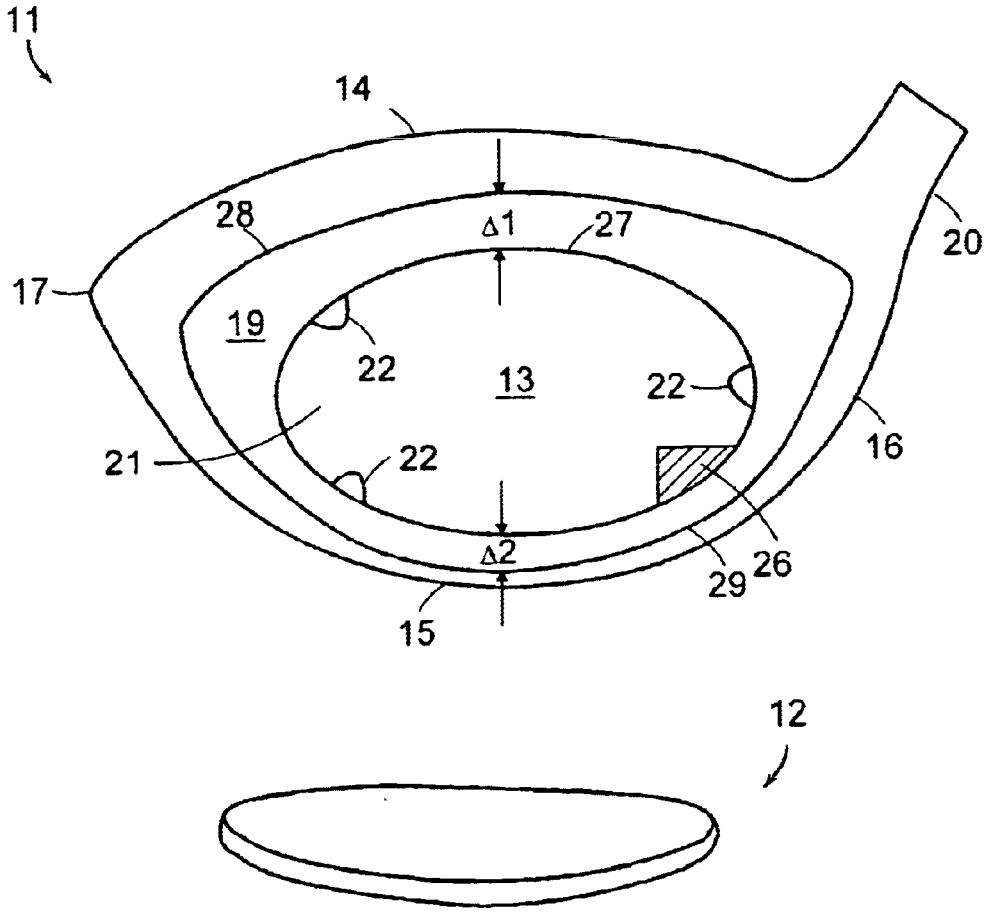
FIG. 1 is a front view of the present invention showing cut out section and stamped metal insert.
Figure 2:
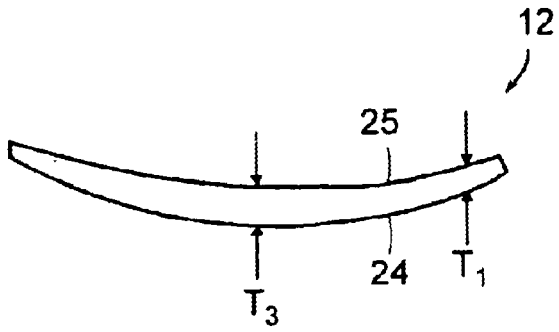
FIG. 2 is a side view of the impact insert of FIG. 1.
Figure 3:
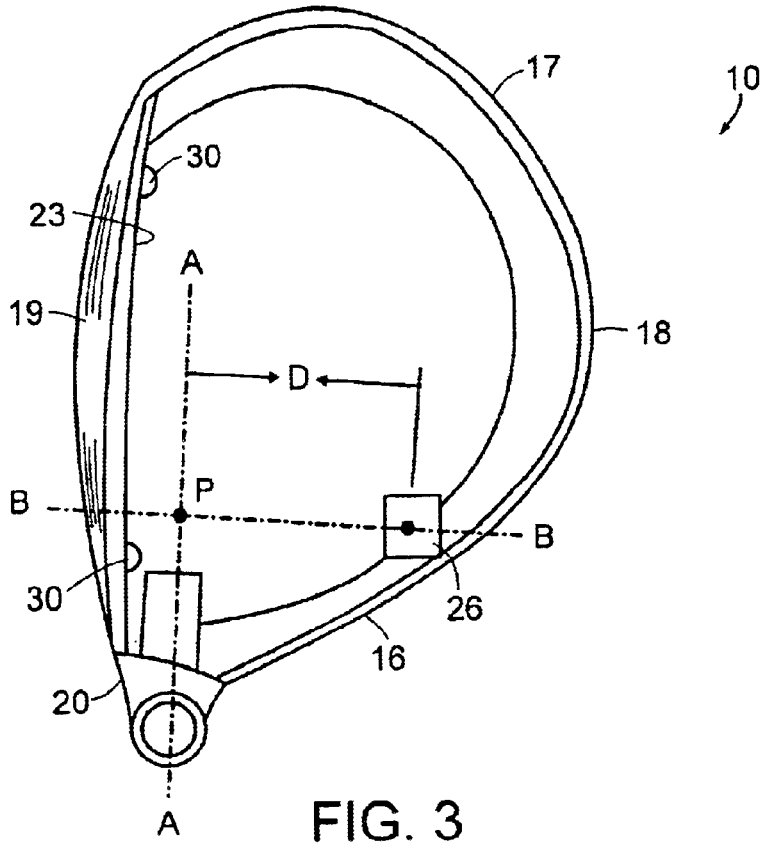
FIG. 3 is a partial top view showing the intersection point where the centerline of the hosel meets the sole plate.
Figure 4:
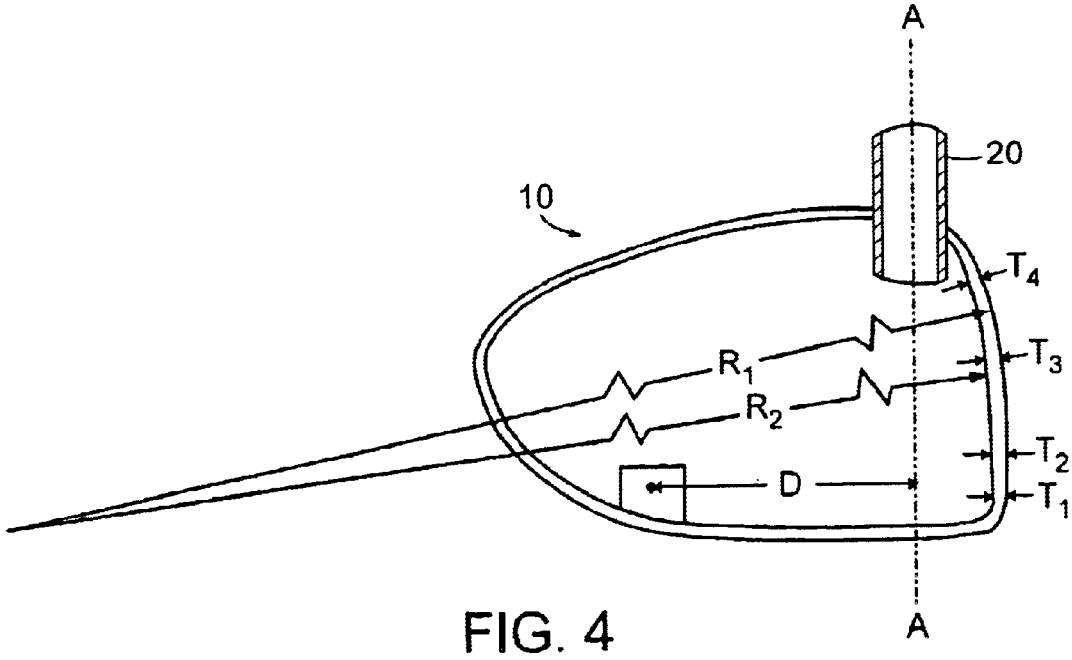
FIG. 4 is a partial cross-sectional side view of a golf club head with a face having a different interior and exterior vertical roll radii.

In FIGS. 1–5, showing the first embodiment of the present invention, there is provided a golf club head 10, which is integrally formed by welding and combining the edges of a body 11 with an impact insert 12 so as to form a cavity 13 therein. The body 11 includes a crown portion 14, a sole plate 15, a heel portion 16, a toe portion 17, a skirt portion 18 and a face perimeter 19. Body 11 can be formed of sheets welded together or cast, preferably from a titanium alloy. The body also includes a hosel 20 that extends from heel portion 16. Hosel 20 includes a bore defining a centerline axis A—A.

An opening 21, that in one embodiment is substantially oval shaped, is defined within face perimeter 19 for receiving impact insert 12. A plurality of chads 22, being in alignment with an inner surface 23 of body 11 provide a pocket within opening 21 for receiving the impact insert 12 which is therein integrally connected by welding. Insert 12 is preferably formed of high strength material and can be cast, forged or stamped sheet metal. Most preferably the insert is stamped sheet metal, and for one embodiment preferably made from a titanium alloy.

The thickness of the impact insert 12 should be preferably between about 0.05" and 0.13". The insert can be uniform thickness or have a thicker center section and thinner outer section. For a preferred embodiment the outer dimension ($T_2$) should be about 0.09" and the center dimension ($T_3$) should be approximately 0.10" controlled by a technique described in co-pending application Ser. No. 09/836,266. It's basically a technique wherein the impact insert 12 has two different radii of curvature. The exterior surface 24 being substantially defined along a first radius R1 and the interior surface 25 being substantially defined along a second radius R2, such that the first radius R1 is less than the second radius R2. The present invention further is adapted towards the face having a vertical roll radius: that being from crown 14 to sole 15. This will allow insert 12 to have less thickness at the outer edge than at the center. The thickness of the impact insert 12 is viewed as a critical compromise between first, being able to achieve the desired "COR", and secondly, providing a club head that is strong enough to withstand the impact forces which occur during collision between club and ball.

In one embodiment of the present invention, the edges 27 of face perimeter 19 are as thin as possible, while still maintaining structural integrity. Preferably the thickness ($T_1$ at the sole/face transition junction 29 and $T_4$ at the crown/face transition junction 28) is approximately the same and is less than 0.11 inches. More preferably, they are less than 0.09 inches and most preferably approximately 0.08" for maximum COR values.

In a preferred embodiment of the present invention, the body 11 includes a face perimeter section 19 that extends from the crown portion 14 over a distance (denoted as Δ1 in the drawings), of at least about 0.15 inches, and also over a distance of about 0.15 inches from the sole plate 15 (Δ2 in drawings). The welds 30 of impact insert 12 to body 11 will be conducted at a suitable distance from the transition junctions 28 and 29. The dimensions of both Δ1 and Δ2 are preferably should not less than 0.20 inches. This construction allows for thin shell thickness at the crown/face transition junction 28 and sole/face transition junctions 29. The thinness of these sections help increase the club head's COR value that extrapolates into greater distance.

In a second embodiment, the body 11 can still be cast from a titanium alloy, but the stamped impact insert 12 can be a stamped titanium alloy sheet metal. The thickness of the impact insert 12 for this embodiments can be a constant measurement of about 0.08 to 0.13 inches for $T_1$, $T_2$, $T_3$ and $T_4$.

For another embodiment, the body 11 and stamped impact insert can be manufactured out of stainless steel. Preferably, the head is more than 270 cubic centimeters and the body is cast and the insert is stamped sheet metal. The thickness of the impact insert 12 for this embodiment is preferably a constant measurement of between about 0.075" to 0.105" for $T_1$, $T_2$, $T_3$ and $T_4$. In another embodiment the club head loft is greater than 13° and the inserts 12 have a constant thickness between about 0.05" to 0.09".

Another important design concept of the present invention is providing a weight element 26 located on the sole plate 15 approximately at the heel/skirt portions 16 and 18. As shown in FIGS. 1 to 5, weight element 26 is preferably centered substantially on a projection B—B extending directly rearward from a point (P) on the sole plate where an extension of the center line A—A of hosel 20 would intersect the sole plate 15. Preferably, the center of gravity of the weight element 26 is adjacent the juncture of the sole and skirt portions 16 and 18. It is preferred that the center of weight element 26 be located at a distance (D) of at least 1.0" and more preferably at least 1.5" from the intersection point P. This is shown on FIG. 3. The weight element 26 is preferably at least 12 grams and more preferably at least 16 grams.

The weight element 26 can be part of the casting or preferably welded into position. More preferably, the weight element 26 is selected from a plurality of weights designed to make specific adjustments to the head weight.

While various descriptions of the present invention are described above, it should be understood that the various features of each embodiment can be used singly or in any combination thereof. Therefore, this invention is not to be limited to only the specifically preferred embodiments depicted herein. Further, it should be understood that variations and modifications within the spirit and scope of the invention may occur to those skilled in the art to which the invention pertains. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

What is claimed is:

1. A metal wood golf club head adapted for attachment to a shaft comprising:

a substantially hollow body welded to a substantially oval shaped stamped metal impact insert;

the body including a heel portion, a toe portion, a crown portion, a sole plate, a skirt portion connecting the heel portion to the toe portion, and a face perimeter having an opening of a configuration for receiving the stamped metal impact insert;

an upper section of the face perimeter forming a transition junction with the crown portion, and a lower section of the perimeter face forming a transition junction with the sole plate; and the opening of the face perimeter at least about 0.20 inch from either the transition junction at the upper section or the transition junction at the lower section, thereby, substantially eliminating welding at the transition junctions.

2. The golf club head of claim 1, wherein a shell thickness of the face perimeter is approximately 0.08 inch.

3. The golf club head of claim 2, wherein the hollow body and the insert are made substantially of titanium or titanium based alloy.

4. The golf club head of claim 3, wherein a variable wall thickness of the insert is approximately 0.10 inch at its center to about 0.09 inch at its outer edge.

5. The golf club head of claim 4, wherein the insert comprises at least two different radii of curvature for interior and exterior surfaces.

6. The golf club head of claim 1, wherein the size of the club head is between about 350 to about 500 cubic centimeters.

7. The golf club head of claim 6, wherein the body and the insert are made from a titanium alloy.

8. The golf club head of claim 1, wherein the size of the club head is between about 270 to about 500 cubic centimeters.

9. The golf club head of claim 8, wherein the body is substantially 6-4 titanium alloy and the insert is substantially 15-3-3-3 titanium alloy.

10. The golf club head of claim 9, wherein the wall of the insert has a thickness between about 0.100 inch to about 0.125 inch.

11. The golf club head of claim 1, wherein the size of the club head is between about 230 to 350 cubic centimeters.

12. The golf club head of claim 11, wherein the wall of the insert has a thickness between about 0.075 inch to 0.105 inch.

13. The golf club head of claim 11, wherein the club head has a loft being equal to or greater than 13°.

14. The golf club head of claim 13, wherein the wall of the insert has a thickness, the thickness dimension being between about 0.05 inch to 0.09 inch.

15. The golf club head of claim 1, wherein the body includes a generally cylindrical hosel extending from the heel portion, an extension of the hosel centerline axis having an intersection point with the sole plate, and a weight element disposed on the sole plate centered at a location substantially rearward from the intersection point in an area adjacent to the juncture of the heel and skirt portions.

16. The golf club head of claim 15, wherein the center of the weight element is disposed at a distance greater than about 1.5 inches from the intersection point.

17. The golf club head of claim 15, wherein the center of the weight element is disposed at a distance greater than about 1.0 inch from the intersection point.

18. The golf club head of claim 15, wherein the weight element is greater than 16 grams.

* * * * *